US005718001A

United States Patent [19]

Wright

[11] Patent Number: 5,718,001

[45] Date of Patent: Feb. 17, 1998

[54] PROTECTIVE EAR COVERING DEVICE

[76] Inventor: Jacquelin E. Wright, 1405 Martha Custis Dr., Alexandria, Va. 22302

[21] Appl. No.: 669,621

[22] Filed: May 24, 1996

[51] Int. Cl.[6] ..... A61F 11/14

[52] U.S. Cl. ..... 2/209; 2/174; 128/864; 128/866

[58] Field of Search ..... 2/209, 174, 423, 2/455; 128/864, 866

*Primary Examiner*—Diana Biefeld
*Attorney, Agent, or Firm*—Alfred F. Hoyte, Jr.

[57] ABSTRACT

A single piece protective ear covering device is provided. The device is designed to protect the ear from heat and hairdressing preparations while the hair of the user is being treated. The device has a pair of mutually opposed ear coverings having a drawstring threaded therethrough and through a central strap for adjusting the ear coverings to a secure, fluid tight position about the ear. The strap is secured to both ear coverings and extends under the users chin when the device is in use. The drawstring is threaded through the strap and extends therefrom allowing for adjustment of the ear coverings about the ears.

1 Claim, 2 Drawing Sheets

PROTECTIVE EAR COVERING DEVICE

BACKGROUND OF THE INVENTION

1. Field of the Invention

The present invention relates to an ear covering and particularly to a protective ear covering device which can be worn while treating the hair.

2. Description of the Prior Art

U.S. Pat. No. 4,223,407 issued to Zappala shows a protective hairdressing visor which can be used to protect the forehead and the ears from hairdressing preparations. The device includes a visor and fluid tight ear coverings. By contrast, the present invention contemplates a protective ear covering which allows the total access to the hair and does not interfere with preparation of the hair.

U.S. Pat. No. 4,660,229 issued to Harris discloses a water-tight ear enclosure. The enclosure is secured to the ear by the combination of an elastic strip and an adhesive strip. By contrast, the present invention contemplates a protective ear covering which is adjustably secured to the ear by a drawstring which is threaded through the covering.

U.S. Pat. No. 5,339,467 issued to Brinkley discloses a hang-type earmuff. One earmuff is attached to each ear and they are not adjustable. By contrast, the present invention contemplates an adjustable protective ear covering which is of single piece construction.

U.S. Pat. No. 4,616,643 issued to Jung discloses a protective ear covering designed to keep water out of the ear. The covering is attached to the user by an adhesive. By contrast, the present invention is designed as both an adjustable heat shield and a fluid impervious ear protector.

As will be seen, the simplicity and effectiveness of my invention is not rivaled in the prior art.

It will be noted that all the prior art devices suffer from the drawback in that they are either relatively complex or require a large number of interchangeable parts.

None of the above inventions and patents, taken either singly or in combination, is seen to describe the instant invention as claimed.

SUMMARY OF THE INVENTION

Briefly, the invention comprises a single piece protective ear covering device which is designed to protect the ear from heat and hairdressing preparations while the hair of the user is being treated. The device has a pair of mutually opposed ear coverings having a drawstring threaded therethrough and through a central strap for adjusting the ear coverings to a secure, fluid tight position about the ear. The strap is secured to both ear coverings and extends under the users chin when the device is in use. The drawstring is threaded through the strap and extends therefrom allowing for adjustment of the ear coverings about the ears.

Accordingly, it is a principal object of the invention to provide a new and improved protective ear covering device which overcomes the disadvantages of the prior art in a simple but effective manner.

It is a major object of this invention to provide a new and improved protective ear covering device which provides an effective shield against heat and chemicals which may be applied to the hair.

It is another object of the invention to provide such an improved device which can be adjusted to fit any user.

It is another object of the invention to provide a protective ear covering device which is a single piece of unitary construction.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
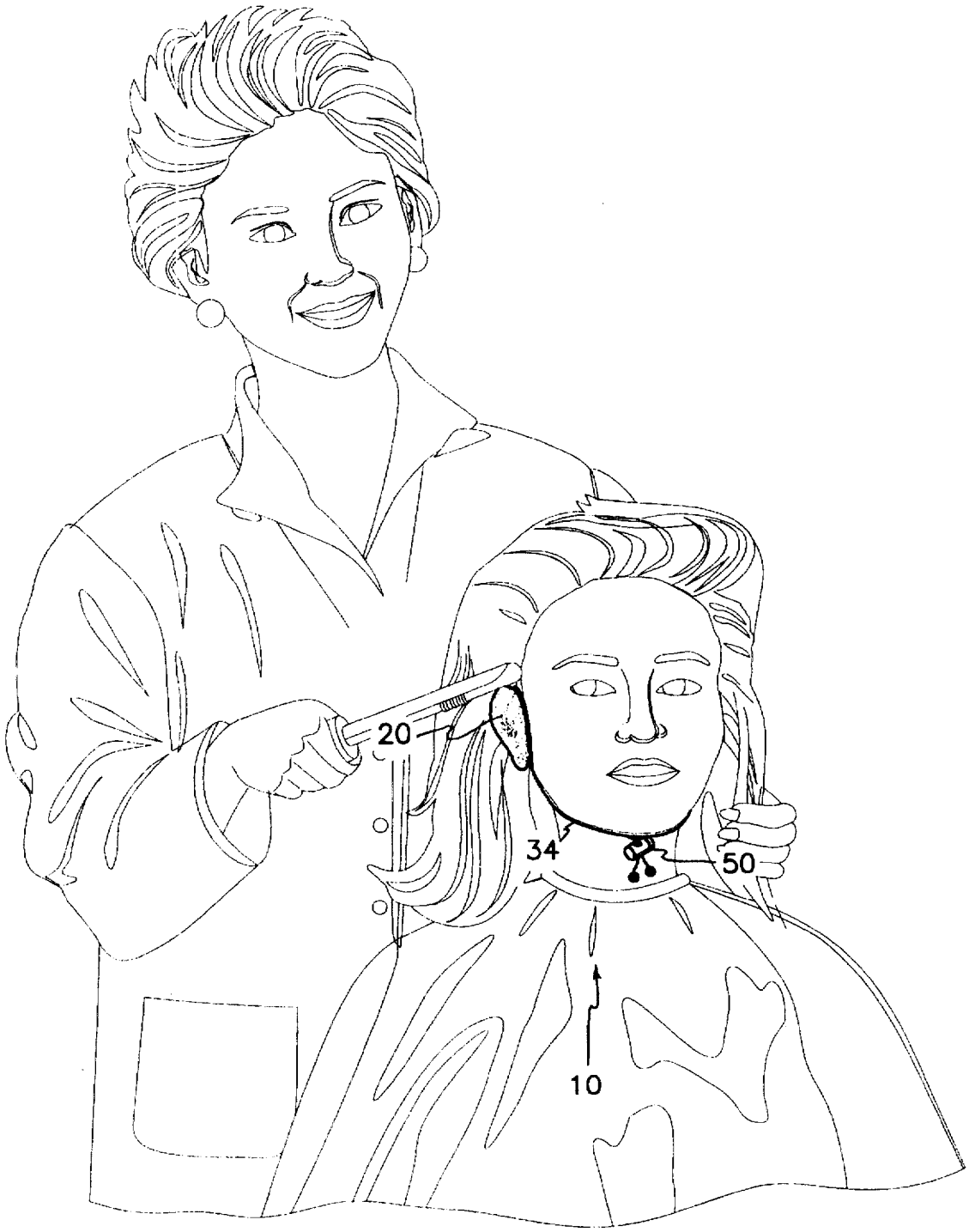
FIG. 1 shows the protective ear covering device of the present invention worn by a user.

Referring now to FIG. 1 a view of one side of the protective ear covering device the present invention, generally designated by the number 10 is shown in place on a user. The device 10 includes a pair of ear coverings 20 securable to each ear of the user and connected to each other by a strap 22 which extends under the chin of the user when the device 10 is in use. The device 10 is designed to protect the ears from burns from curling irons, hot combs, blow dryers and the like; as well as chemicals which are used while preparing the hair as will be explained in more detail later.

Figure 2:
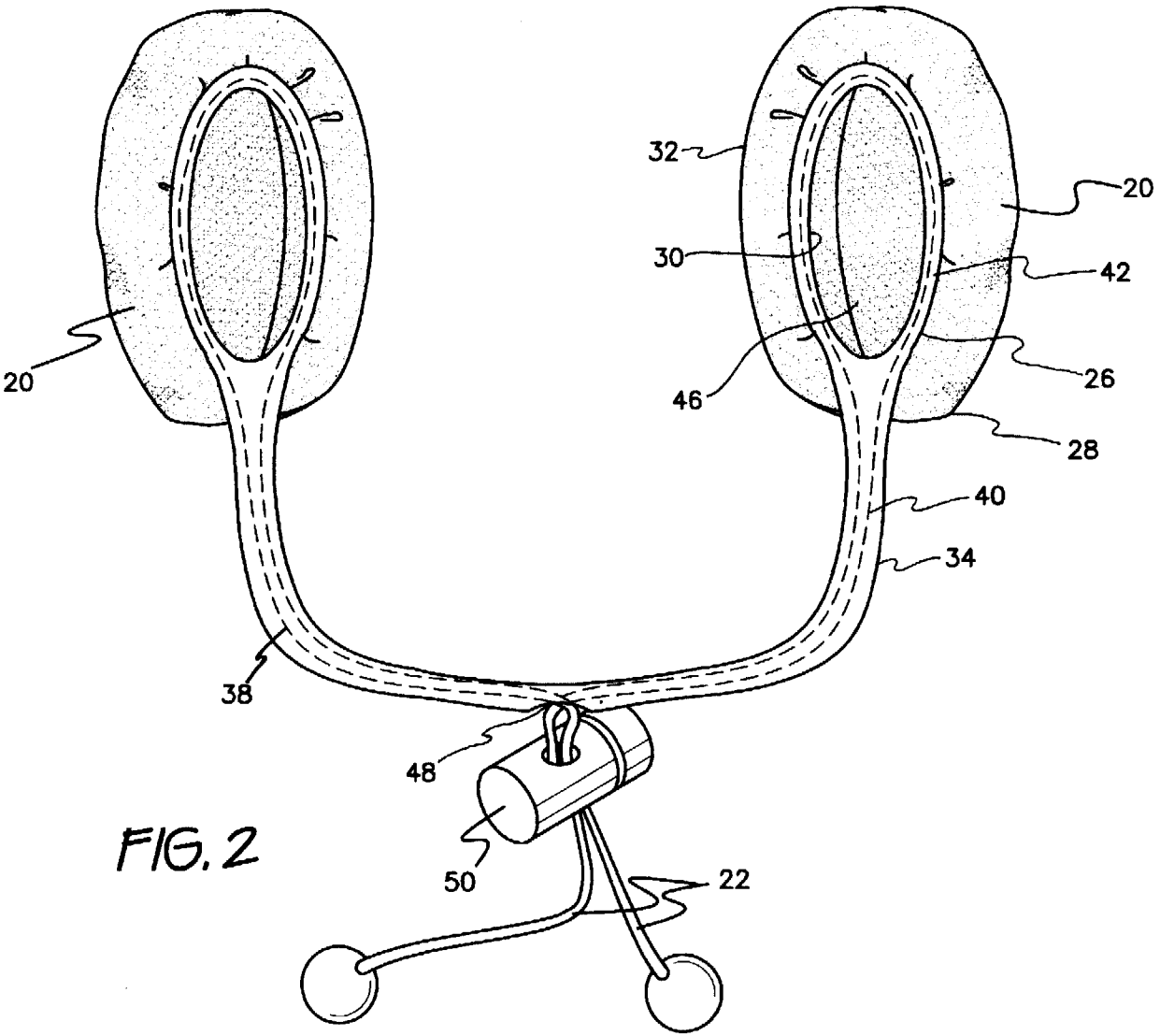
FIG. 2 is a partially broken away front view of the protective ear covering device of the present invention showing the drawstring.

The front view of FIG. 2 is partially broken away to show the inner lining 26 and outer lining or shell 28. The inner lining 26 is preferably made of some heat and flame resistant material such as a PTFE polymer. The material used for the inner lining 26 should be sufficiently thick to prevent the transmission of heat from sources such as curling irons to the user's ear. It can be readily appreciated that a heat resistant foam material, with its inherent air gaps, would be a particularly effective alternative for the inner lining 26.

The outer lining or shell 28 has an interior layer 30 and an exterior layer 32 which are stitched together or otherwise joined so as to completely enclose the inner lining 26. The shell 28 is relatively thin and preferably made from a flexible, waterproof material such as polyethylene.

A strap 34 connects the ear coverings 20 and allows for adjustment of the ear coverings via drawstrings 38, 40. The drawstrings 38, 40 are threaded through the strap 34 into a passage 42 which is formed in the shell 28 about the opening 46 which receives the ear of the user. The drawstrings 38, 40 extend through an aperture 48 in the strap 34 where they can be accessed by the user in order to adjust the fit of the device as will be explained later. Alternatively, a single drawstring may be used. An apertured tightening device 50 may have the drawstrings 38, 40 threaded therethrough as is known in the art. Alternatively, the drawstrings 38, 40 may be tied together.

In operation, the device 10 is secured in place on the user by placing the ear coverings 20 about the ears of the user so that the user's ears are completely encircled by the coverings 20. The user can then tighten the drawstrings 38, 40 until the opening 46 conforms to the shape of the user's ear. The device 10 can be disposable or washable so that it may be susceptible to multiple uses. Once in place the user's hair can be styled as desired.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A protective ear covering device comprising:

a pair of mutually opposed ear coverings each having an outer shell and an inner lining, each of said ear coverings having an adjustable opening through which a user's ear may be inserted;

each of said outer shells completely enclosing one of said inner linings and having a passage formed therein, the passages defining said openings and each of the passages adapted to receive a drawstring;

a strap connecting said ear coverings and also having an interior passage, said interior passage contiguous with the passages formed in the outer shells of the ear coverings so as to allow the drawstrings to be passed through said passage in said strap and into the passages in the outer shells of the ear coverings, the strap further having an opening through which each of the drawstring may extend;

whereby said ear coverings may be adjustably secured about the ears of a user by pulling said drawstrings.

* * * * *